US007407277B2

(12) United States Patent
Yoneyama

(10) Patent No.: US 7,407,277 B2
(45) Date of Patent: Aug. 5, 2008

(54) INKJET RECORDING APPARATUS

(75) Inventor: Tsutomu Yoneyama, Kunitachi (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 330 days.

(21) Appl. No.: 11/109,736

(22) Filed: Apr. 20, 2005

(65) Prior Publication Data

US 2005/0237352 A1 Oct. 27, 2005

(30) Foreign Application Priority Data

Apr. 27, 2004 (JP) ..... 2004-131416

(51) Int. Cl.
*B41J 2/01* (2006.01)

(52) U.S. Cl. ..... 347/102

(58) Field of Classification Search ..... 347/102
See application file for complete search history.

(56) References Cited

U.S. PATENT DOCUMENTS

2003/0142168 A1 * 7/2003 Suzuki et al. ..... 347/43

FOREIGN PATENT DOCUMENTS

JP 2003285422 * 10/2003

* cited by examiner

*Primary Examiner*—Julian D Huffman
(74) *Attorney, Agent, or Firm*—Finnegan, Henderson, Farabow, Garrett & Dunner, L.L.P.

(57) ABSTRACT

An inkjet recording apparatus includes an image recording head for jetting image recording ink onto a recording medium conveyed in a sub scanning direction, while the recording head reciprocally moving in the main scanning direction, the image recording head having an image recording nozzle array including a plurality of nozzles; an auxiliary recording head for jetting auxiliary recording ink for enhancing image recording, the auxiliary recording head having an auxiliary recording nozzle array including a plurality of nozzles, the auxiliary recording nozzle array being disposed along the sub scanning direction in parallel to the image recording nozzle array; and a control section for controlling the image recording nozzle array and the auxiliary recording nozzle array so as to change respective ink jetting areas by selecting nozzles, for respectively jetting ink, from the image recording nozzle array and the auxiliary recording nozzle array, according to a recording mode.

4 Claims, 5 Drawing Sheets

INKJET RECORDING APPARATUS

This application is based on Japanese Patent Application No. 2004-131416 filed on Apr. 27, 2004, in Japanese Patent Office, the entire content of which is hereby incorporated by reference.

FILED OF THE INVENTION

The present invention relates to an inkjet recording apparatus, and particularly relates to an inkjet recording apparatus that uses auxiliary recording ink such as background ink and transparent ink in addition to image recording ink mostly used to record images.

BACKGROUND OF THE INVENTION

In recent years, inkjet recording devices have come to be used more than gravure printing type or flexo printing type devices, which require prepress process, because inkjet recording devices allows easy and inexpensive image forming.

In the field of image recording on commodities or packing materials for commodities by the use of such an inkjet recording device, materials such as resins or metals, which do not absorb ink, are often used for commodities or packing of commodities. Photocurable ink is used to fix ink on a recording medium which does not absorb ink. After jetting photocurable ink onto a recording medium, light such as UV light is projected onto the ink to fix the ink by curing.

In this field, images including characters, symbols, and pictures are recorded with a background color such as white on a transparent packing material, for example. In case of printing a background on a transparent packing material in such a manner, front recording or back recording is performed. In front recording, background ink is first jetted onto the front surface of a recording medium in a solid state, and then an image is recorded on the background ink. In back recording, an image is recorded first on the back surface of a recording medium, and then background ink is jetted in a solid state on the image. Further, in recording an image on a color recording medium, sometimes, color ink is jetted onto white ink having been jetted in the shape of the image so that the image is recorded to improve the coloring of the image, or, transparent ink is jetted onto the surface of a recorded image to improve smoothness and gloss tone.

As an inkjet recording apparatus for image recording by the use of inks in various colors mostly for image recording and an auxiliary recording ink such as a background ink or a transparent ink that enhances image recording, there are known inkjet recording apparatuses (see Patent Document-1, for example) as follows. That is, there is known an inkjet recording apparatus which includes recording heads with nozzles for jetting ink, reciprocally moves the recording heads in the main scanning direction while jetting ink from the recording heads onto a recording medium, and conveys the recording medium in the sub scanning direction orthogonal to the main scanning direction, wherein an auxiliary recording head for jetting auxiliary recording ink is disposed on both sides, in the main scanning direction, of the image recording heads for jetting image recording inks in respective colors.

For example, in performing front recording by such an inkjet recording apparatus, the apparatus records a background by jetting ink in a solid state from an auxiliary recording head positioned on the upstream side of image recording heads while the recording heads are moving in both the outward direction and the return direction, and by jetting ink from the image recording heads based on image data to record an image. In performing back recording, the apparatus does not jet ink from an auxiliary recording head positioned on the upstream side of the image recording heads while the recording heads are moving in the outward direction nor the return direction, but jets ink from the image recording heads to record an image based on image data and jets ink in a solid state from the auxiliary recording head positioned on the downstream side of the image recording heads to record a background.

Further, there is also known an inkjet recording apparatus (see Patent Document 1, for example) which includes auxiliary recording heads disposed on both the upstream side and the downstream side, in the sub scanning direction, of image recording heads for respective colors.

For example, in performing front recording by such an inkjet recording apparatus, the apparatus jets ink in a solid state from an auxiliary recording head positioned on the upstream side of image recording heads in the sub scanning direction to record a background, and after the recording medium on which the background has been recorded is conveyed in the sub scanning direction, the apparatus jets ink from the image recording heads onto the part where the background has been recorded, so as to record an image. In performing back recording, the apparatus does not jet ink from an auxiliary recording head positioned on the upstream side of the image recording heads in the sub scanning direction, but jets ink from the recording heads to record an image, and after the recording medium on which the image has been recorded is conveyed in the sub scanning direction, the apparatus jets ink in a solid state, from an auxiliary recording head positioned on the downstream side of the image recording heads, on the part where the image has been recorded, so as to record a background.

[Patent Document 1] TOKKAI No. 2003-285422

However, in a known inkjet recording apparatus, an auxiliary recording head is arranged on each side of image recording heads in the main scanning direction, or at least on one of the upstream and the downstream sides in the sub scanning direction, which causes a problem of a larger size of a carriage having the recording heads and also a larger size of the entire apparatus, and a high manufacturing cost of the apparatus. Further, if an auxiliary recording head is provided at least on one of the upstream side and downstream side of image recording heads in the sub scanning direction, the area of a platen supporting a recording medium becomes larger to cause a problem of degrading image quality due to drop in conveyance accuracy caused by friction and absorption force between the platen and the recording medium.

Further, particularly with an inkjet recording apparatus for recording an image using photocurable ink, in order to prevent mixture of inks jetted spuerimposedly and blurring of ink, it is necessary to project light onto ink having been jetted so that the ink is fixed on a recording medium and thereafter jet ink newly.

Therefore, in the case where auxiliary recording heads are provided respectively on both sides of image recording heads in the main scanning direction, light emitters for projecting light onto ink having landed on a recording medium are needed to be provided not only on both the side portions, in the main scanning direction, of a head unit having the image recording heads and the auxiliary recording heads, but also between an image recording head and an auxiliary recording head, causing problems of a larger size of the carriage, degradation of image quality due to heat created by the light emitters, and a larger power consumption.

Further, in the case where an auxiliary recording head is provided at least on one of the upstream side and the down stream side of image recording heads in the sub scanning direction, in order to simplify the structure of a light emitter and to project light onto ink jetted from both the image recording heads and the auxiliary recording head, the light emitter is arranged from the upstream side to the downstream side of the image recording heads and the auxiliary recording head in the sub scanning direction, which causes the problems of a large size of the light emitter, degradation of image quality due to heat generation, and large power consumption.

SUMMARY OF TEE INVENTION

With the background stated above, an object of the invention is to provide an inkjet recording apparatus that is capable of recording by superimposing image recording ink and auxiliary recording ink, such as background ink, is small sized with a low manufacturing cost of the apparatus, and further provides fine image quality.

In an aspect of the invention, an inkjet recording apparatus includes an image recording head for jetting image recording ink onto a recording medium conveyed in a sub scanning direction orthogonal to a main scanning direction, while the image recording head reciprocally moving in the main scanning direction, the image recording head having an image recording nozzle array including a plurality of nozzles for jetting ink, the image recording nozzle array being disposed along the sub scanning direction; an auxiliary recording head for jetting auxiliary recording ink for enhancing image recording onto the recording medium, while the auxiliary recording head reciprocally moving in the main scanning direction, the auxiliary recording head having an auxiliary recording nozzle array including a plurality of nozzles for jetting ink, the auxiliary recording nozzle array being disposed along the sub scanning direction in parallel to the image recording nozzle array; and a control section for controlling the image recording nozzle array and the auxiliary recording nozzle array so as to change respective ink jetting areas by selecting nozzles, for respectively jetting ink, from the image recording nozzle array and the auxiliary recording nozzle array, according to a recording mode.

DETAILED DESCRIPTION OF THE PREFERRED EMBODIMENTS

A first preferred embodiment in accordance with the invention will now be described, referring to FIGS. 1 to 3.

Figure 1:
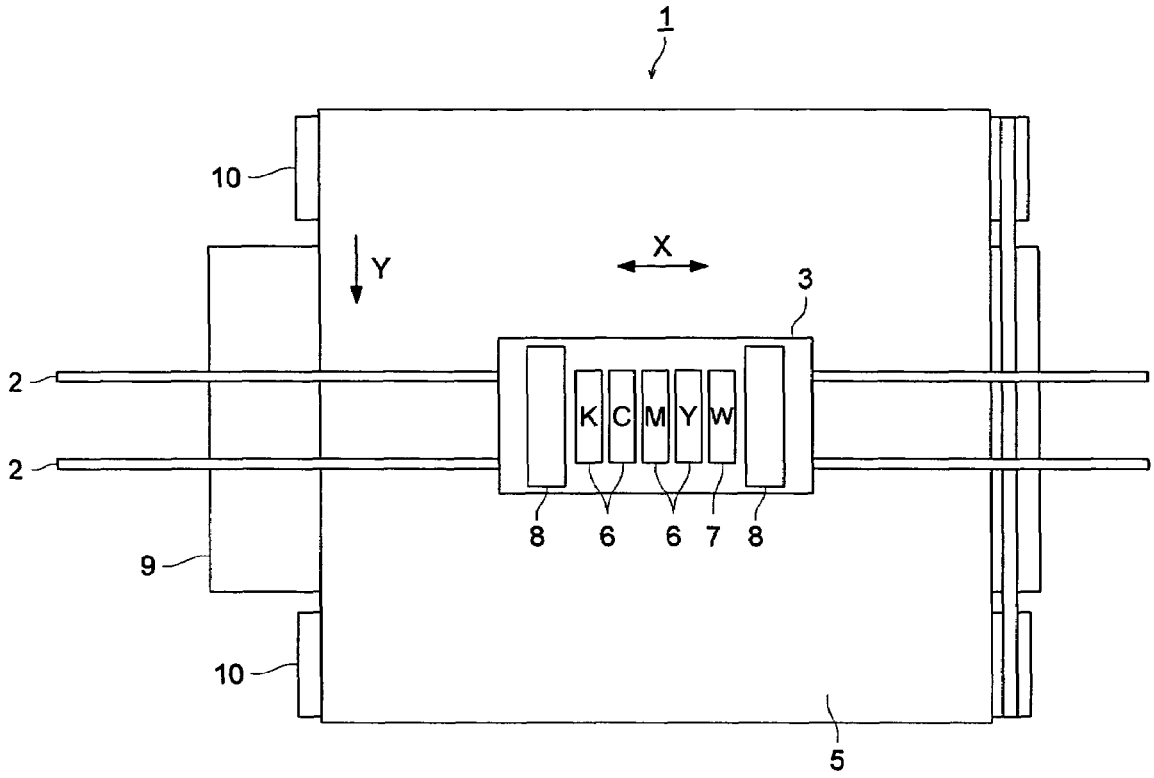
FIG. 1 is a plan view showing a structure of an inkjet recording apparatus in a first embodiment of the invention.

FIG. 1 shows an inkjet recording apparatus 1 of a serial head type in an embodiment in accordance with the invention. The inkjet recording apparatus 1 includes, as shown in FIG. 1, guide rails 2 in the shape of bars which support a carriage 3. The carriage 3 is reciprocally moved by a carriage driving mechanism 4 (see FIG. 2) along the guide rails 2 in sub scanning direction X.

In the central part of the carriage 3, there are mounted image recording heads 6 formed with nozzles for jetting inks as image recording inks, for mostly recording an image, in respective colors of yellow (Y), magenta (M), cyan (C), and black (K), and there is also mounted an auxiliary recording head 7, for enhancement of image recording, formed with nozzles for jetting white ink (W) for recording a solid white background of the image recorded with the image recording inks, the recording heads being disposed in a row in main scanning direction X.

Inks used in the present embodiment are UV curable inks which are cured when exposed to UV light. The UV curable inks can be a radical polymerizable ink containing a radical polymerizable compound, as a polymerizable compound, a cation polymerizable ink containing a cation polymerizable compound, or a hybrid type ink being a combination of a radical polymerizable ink and a cation polymerizable compound. Incidentally, the ink may be prepared by applying a polymerizable compound which is polymerized and cured by light other than UV light and applying a light initiator for initiating polymerization between polymerizable compounds with light other than UV light, such as electronic ray, X-ray, and infrared ray.

As a recording medium 5 used by the inkjet recording apparatus 1 in accordance with the invention, it is possible to apply various types of paper such as plain paper, recycled paper, and glossy paper, various fabrics, various nonwoven fabrics, resins, metals, and various types of glass. A transparent non-ink-absorbing resin film used for soft packaging is particularly and preferably applied in the present embodiment.

On both sides of the head unit having the image recording heads 6 and the auxiliary recording head 7, UV emitters 8 are arranged as light emitters for projecting UV light onto ink jetted from nozzles onto the recording medium 5, respectively from the upstream end to the downstream end in sub scanning direction Y along which the recording medium 5 is conveyed orthogonal to main scanning direction X by the heads 6 and 7.

The central part of the area where the carriage 3 can move serves as a recording area where recording on the recording medium 5 is performed. In this recording area, there is provided a platen 9 which horizontally supports the recording medium 5 from the non-recording surface.

The inkjet recording apparatus 1 is provided with a conveying mechanism 11 (see FIG. 2) for conveying the recording medium 5 in sub scanning direction Y, the mechanism 11 including a plurality of conveying rollers 10. The conveying mechanism 11 intermittently conveys the recording medium 5 by repeatedly conveying and stopping the recording medium 5, in synchronization with the motion of the carriage 3 during recording.

On the top surface of the housing of the inkjet recording apparatus 1, there is provided an input operation section 12 having a touch panel, for example, and displays user selectable recording modes to be selected and input by a user, wherein the user selects and inputs a recording mode through the input operation section 12. The input operation section 12 is connected with a control section 13, later described, and outputs signals related to the selected recording mode through a predetermined operation, to the control section 13.

Figure 2:
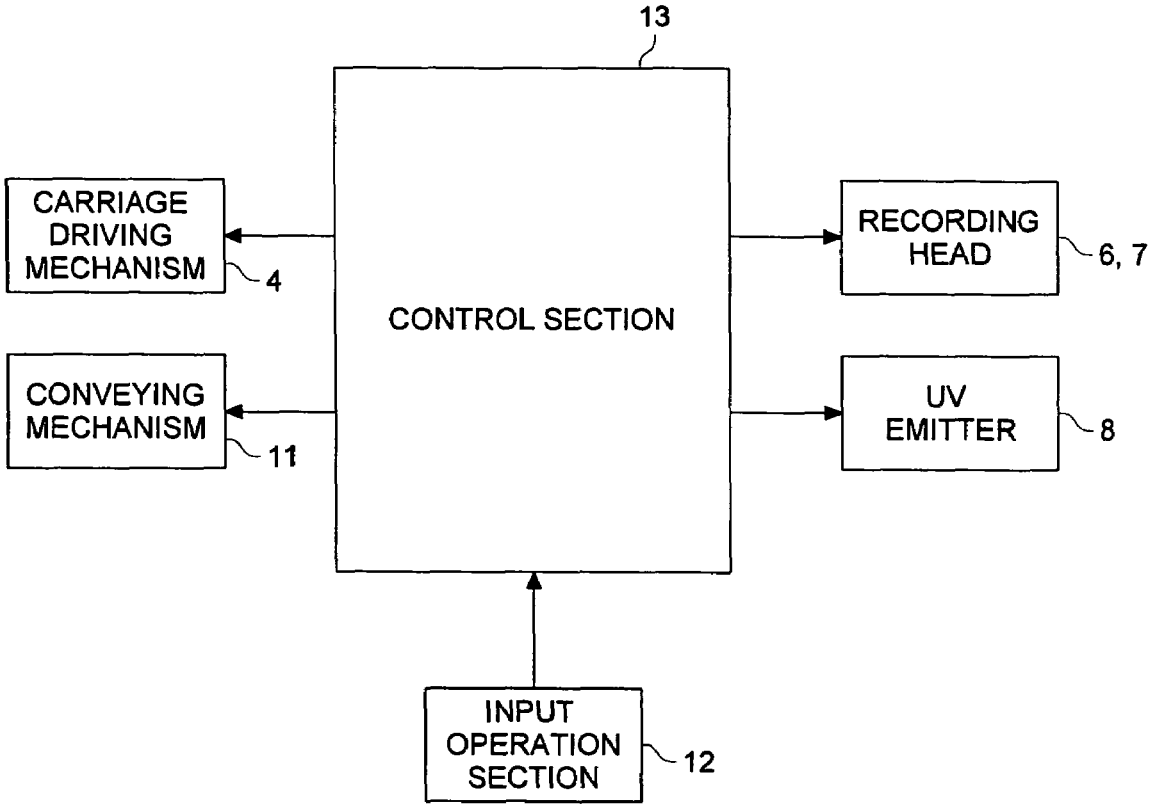
FIG. 2 is a block diagram showing a control section for controlling the inkjet recording apparatus 1 and sections connected to the control section in the first embodiment.
Figure 3:
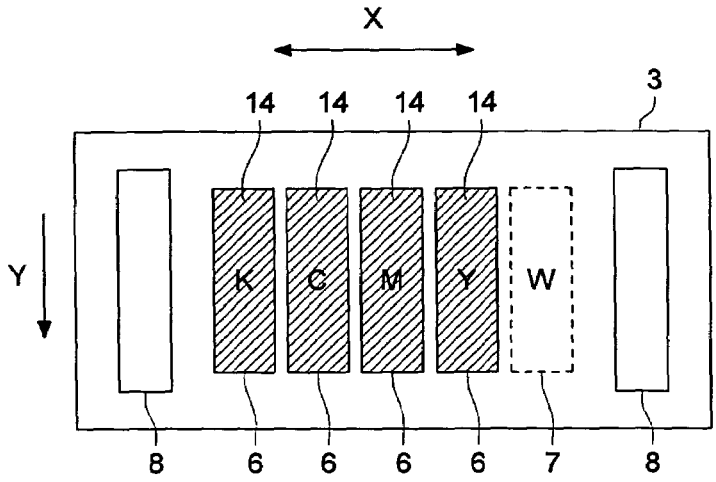
FIGS. 3A to 3C are schematic diagrams showing ink jetting areas of image recording heads and an auxiliary recording head of the inkjet recording apparatus in the first embodiment.
Figure 3:
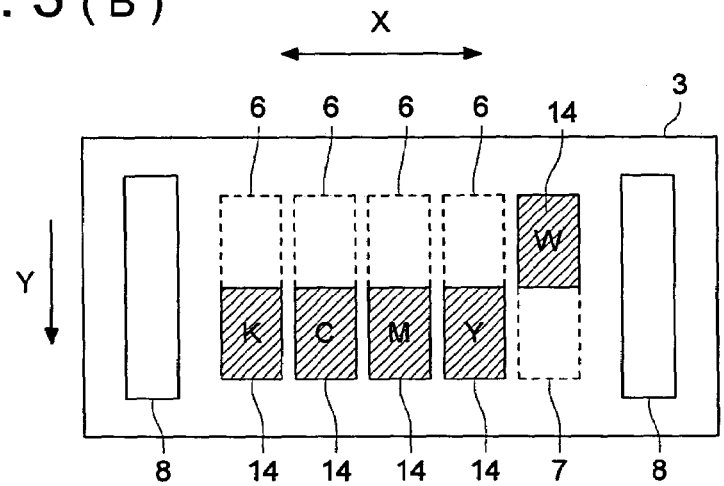
Figure 3:
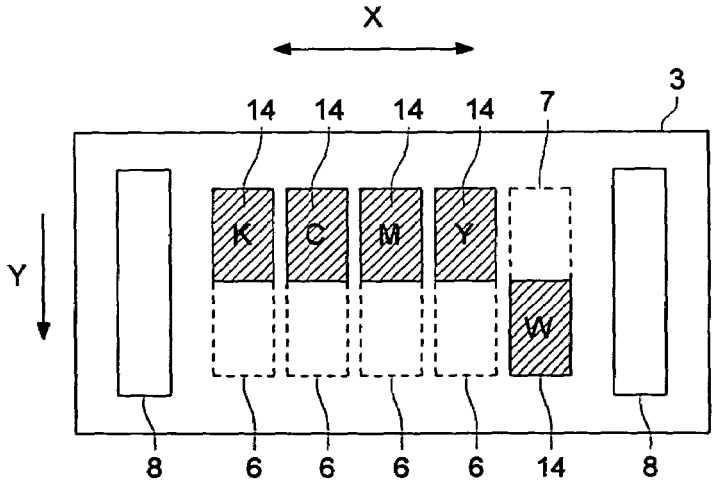

FIG. 2 shows a control device for controlling the inkjet recording apparatus 1 in the present embodiment. The control device includes, for example, a CPU, RAM, ROM (none of them being shown) and has a control section 13 for expanding a processing program recorded in a ROM, to a RAM and executes the processing program by a CPU.

According to the above stated processing program and based on the status of operation of the carriage driving mechanism 4, the recording heads 6 and 7, the conveying mechanism 11, the UV emitters 8, and the like, the control section 13 controls operation of the respective members.

Particularly, in the inkjet recording apparatus 1, the control section 13 selects respective ink jetting areas 14 for jetting ink from the image recording heads 6 and the auxiliary recording head 7, according to a recording mode, controls the image recording heads 6, the auxiliary recording head 7, the conveying mechanism 11, and the like so that the selected ink jetting areas 14 jet ink to record an image.

As recording modes, the apparatus includes, for example, the following three recording modes, namely, a normal mode which performs image recording by the use of image recording ink only, a front recording mode which jets white ink in a sold state onto the front surface of the recording medium 5 and records an image by the use of image recording inks on the white ink, and a back recording mode which records an image on the back surface of the recording medium 5 by the use of image recording inks and jets white ink in a solid state on the image.

Now, selection of ink jetting areas in the respective recording modes will be described in detail. When the control section 13 receives an input signal related to the normal mode from the input operation section 12, the control section 13 selects, as ink jetting areas 14 and as shown in FIG. 3A, the respective entire image recording heads 6, that is, the entire nozzle arrays formed on the respective image recording heads 6 and disposed in sub scanning direction Y. Herein, in the normal mode, auxiliary recording ink such as white ink may be used as image recording ink to record an image. In this case, an image recording head is a concept that includes an auxiliary recording head to be used not for auxiliary recording but for image recording.

When a signal related to the front recording mode is input via the input operation section 12, the control section 13 selects, as shown in FIG. 3B, half of the nozzle array on the downstream side in sub scanning direction Y, as the ink jetting area 14 for each image recording head 6, and selects half of the nozzle array on the upstream side in sub scanning direction Y, as the ink jetting area 14 for the auxiliary recording head 7.

When a signal related to the back recording mode is input via the input operation section 12, the control section 13 selects, as shown in FIG. 3C, half on the upstream side of the nozzle array in sub scanning direction Y as the ink jetting area 14 for each image recording head 6, and selects half on the downstream side of the nozzle array in sub scanning direction Y as the ink jetting area 14 for the auxiliary recording head 7.

Next, operation and functions of the present embodiment will be described.

In recording an image on the recording medium 5, the user selects a recording mode and inputs the mode via the input operation section 12. Then, a signal related to the selected recording mode is input to the control section 13, and the control section 13 determines ink jetting areas 14 corresponding to the selected recording mode. Next, the carriage driving mechanism 4 reciprocally moves the carriage 3 above the recording medium 5 in main scanning direction X, and ink is jetted from the determined ink jetting areas 14 of the respective recording heads. Jetted ink successively lands on the recording medium 5. The ink having landed on the recording medium 5 is exposed to UV light by UV emitters 8 reciprocally moving with the carriage 3 so that the ink is cured on the surface of the recording medium.

Specifically, when the normal mode is selected, the control section 13 uses the entire image recording heads 6 to serve as ink jetting areas 14, and all nozzles are used. Inks in respective colors are jetted from nozzles according to image data, out of all the nozzles. In both the outward direction and the return direction, the UV emitter 8 positioned on the downstream side of the recoding heads 6 successively projects UV light onto ink having landed on the recording medium 5 to cure the ink. Thus, an image without a background is recorded on the recording medium 5.

When the front recording mode is selected, the control section 13 uses the portion on the downstream side, in sub scanning direction Y, of the nozzle array of each image recording head 6 and the portion on the upstream side, in sub scanning direction Y, of the nozzle array of the auxiliary recording head 7 to serve as ink jetting areas 14. In each one main scanning, white ink is jetted in a solid state from the nozzles on the upstream side of the auxiliary recording head, and inks in the respective colors are jetted, based on image data, from nozzles on the downstream side of the image recording heads 6. In both the outward direction and the return direction, the UV emitter 8 positioned downstream side of the head unit in main scanning direction X successively projects UV light onto ink having landed on the recording medium 5.

Herein, the ink jetting area 14 of the auxiliary recording head 7 is positioned on the upstream side of the ink jetting area 14 of the image recording heads 6 in sub scanning direction Y. Therefore, after white ink having been jetted in a solid-state from the auxiliary recording head 7 and landed on the recording medium 5 is cured by UV light on the recording medium 5 in one main scanning, the portion onto which the white ink has been jetted in a solid state is conveyed in sub scanning direction Y, and ink is jetted from the image recording heads 6 onto this portion to record an image in the next one main scanning. In such a manner, an image on a white-colored background is recorded on the recording medium 5.

When the back recording mode is selected, the control section 13 makes the portion on the upstream side, in sub scanning direction Y, of the nozzle array of each image recording head 6 and the portion on the downstream side, in sub scanning direction Y, of the nozzle array of the auxiliary recording head 7, serve as ink jetting areas 14. In one main scanning, inks in the respective colors are jetted from the nozzles on the upstream side of the image recording heads 6, based on image data, onto the back surface of the recording medium 5, and white ink is jetted in a solid state from the nozzles on the downstream side of the auxiliary recording head 7. In both the outward direction and the return direction, the UV emitter 8, positioned on the downstream side of the recoding heads 6 in main scanning direction X, successively projects UV light onto ink having landed on the recording medium 5.

Herein, the ink jetting area 14 of each image recording head 6 is positioned on the upstream side, in sub scanning direction Y, of the ink jetting area 14 of the auxiliary recording head 7. Therefore, after inks in the respective colors are jetted from the image recording heads 6, based on image data, and cured on the recording medium 5 by UV light in one main scanning, the portion on which an image has been recorded is conveyed in sub scanning direction Y, and white ink is jetted in a solid-state from the auxiliary recording head 7 onto this portion in the next one main scanning. In such a manner, an image with a white background is recorded on the recording medium 5.

Thus, in a case where image recording ink and auxiliary recording ink are to be superimposed, recording can be performed in such a manner that the nozzle area of a head that jets ink initially is selected to be on the upstream side, in the sub scanning direction, of the nozzle area of a head that jets ink subsequently. Thus, jetted ink on the upstream side is exposed to UV light projected from the upstream side, in sub scanning direction Y, of the UV emitters 8 provided on both sides of the head unit, and thus cured. Therefore, it is neither necessary to provide an auxiliary recording head 7 on both sides of the group of the image recording heads 6, nor to provide a UV emitter 8 between the group of the image recording heads 6 and the auxiliary recording head 7.

Further, it is neither necessary to provide an auxiliary recording head 7 on the upstream side nor on the downstream side of the image recording heads 6 in sub scanning direction Y. Accordingly, the UV emitters 8 need not to be of the total added length of an image recording head 6 and the auxiliary recording head 7 in sub scanning direction Y.

As stated above, in the present embodiment, it is neither necessary to provide an auxiliary recording head 7 on both sides of the group of the image recording heads 6, nor to provide an auxiliary recording head 7 on the upstream side nor on the downstream side of the image recording heads 6 in sub scanning direction Y. Therefore, it is possible to downsize the carriage 3 having recording heads on it, and thereby the entire apparatus, and also to reduce the manufacturing cost of the apparatus. Further, since the area of the platen 9 for supporting the recording medium 5 can be reduced, conveying accuracy is not degraded, and images with higher quality can be provided.

Further, it is neither necessary to provide a UV emitter 8 between the image recording heads 6 and the auxiliary recording head 7, nor to provide a UV emitter with a total added length of an image recording head 6 and the auxiliary recording head 7, that is, the length twice as long as one head in sub scanning direction Y. Therefore, it is possible to downsize the apparatus, reduce the manufacturing cost of the apparatus, and provide images with higher image quality, reducing the amount of heat generation by the UV emitters 8.

In the present embodiment, in the front recording mode and in the back recording mode, half of the nozzles on the upstream side or half of the nozzles on the downstream side of the nozzle array is selected for each head 6 or head 7, as an ink jetting area 14. However, the invention is not limited to this, and it is also allowed to select, for example, one third of the nozzles on the upstream side or one third of nozzles on the downstream side. It is also possible, for example, to make nozzles in a certain part of the nozzle array of each head on the downstream side in sub scanning direction Y serve as spare nozzles for replacement of nozzles with which jetting failure has occurred, while the other nozzles may be divided such that ink jetting areas 14 are selectable, according to each recording mode. In this case, the entire head for image recording means the entire nozzle array, excluding nozzles serving as spare nozzles.

In the present embodiment, inks of colors of yellow (Y), magenta (M), cyan (C), and black (K) are used as image recording ink, and white ink is used as auxiliary ink. However, the colors of ink to be used are not limited to these. For example, eight colors, including light yellow (LY), light magenta (LM), light cyan (LC), and light black (LK), may be employed as image recording ink, and special colors such as silver may be employed as auxiliary ink.

Further, although in the present embodiment, white ink is jetted in a solid-state from the auxiliary recording head 7 to record an image with a white background, it is also possible to jet white ink in dots into a shape of an image, and image is recorded with ink in respective colors, superimposedly on the jetted white ink, so that an image with high coloring is provided. In this case, a subsequent recording mode is to be selectable, in which auxiliary recording ink is jetted first and then image recording ink is superimposed. In the subsequent recording mode, for example, half of the nozzles on the downstream side of the nozzle array in sub scanning direction Y is set to be the ink jetting area 14 for each image recording head 6, and half of the nozzles on the upstream side of the nozzle array in sub scanning direction Y is set to be the ink jetting area 14 for the auxiliary recording head 7, wherein the control section 13 controls the image recording heads 6 and the auxiliary recording head 7 to jet ink.

Still further, it is possible to obtain an image having a smooth appearance or a glossy tone by jetting transparent ink from the auxiliary recording head 7, superimposing it onto an image previously recorded with inks in respective colors. In this case, the initial recording mode is to be selectable, in which image recording is performed with image recording ink first and then auxiliary ink is superimposed. In the initial recording mode, for example, half of the nozzles on the upstream side of the nozzle array in sub scanning direction Y is set to be the ink jetting area 14 for each image recording head 6, and half of the nozzles on the downstream side of the nozzle array in sub scanning direction Y is set to be the ink jetting area 14 for the auxiliary recording head 7, wherein the control section 13 controls the image recording heads 6 and the auxiliary recording head 7 to jet ink.

Yet further, for example, the auxiliary recording head 7 may be arranged to be a head for jetting white ink in a solid-state, a head for jetting transparent ink, or a head for jetting ink into a shape of an image, or a head for jetting transparent ink. It is also possible to arrange the auxiliary recording head 7 which allows selection from jetting of white ink in a solid-state or jetting of white ink into a shape of an image.

Next, an inkjet recording apparatus in a second embodiment in accordance with the invention will be described, referring to FIGS. 4A to 4C. An inkjet recording apparatus 20 in the present embodiment is structured almost the same as the apparatus in the first embodiment, except for disposition of image recording heads 6 and an auxiliary recording head 7, and control of the ink jetting operation. Therefore, only differences from the first embodiment will be specifically described below.

The inkjet recording apparatus 20 includes a carriage 3 which reciprocally moves above a recording medium in main scanning direction X, driven by a carriage driving mechanism (not shown). In the central part of the carriage 3, there are mounted image recording heads 6 formed with nozzles for jetting inks in respective colors of yellow (Y), magenta (M), cyan (C), and black (K), onto a recording medium, and an auxiliary recording head 7 formed with nozzles for jetting a white ink (W), as an auxiliary recording ink to enhance the recording of an image, the white ink serving to provide a solid white background of the image recorded by the image recording inks. Herein, two nozzle arrays for each color are disposed along sub scanning direction Y in a state where the nozzle arrays for each same color being shifted from each other by the width of a head in main scanning direction X, and the nozzle arrays of the respective colors are aligned in the main scanning direction X.

On both sides of a head unit having image recording heads 6 and an auxiliary recording head 7, UV emitters 8 for projecting UV light onto ink jetted from nozzles onto a recording medium is provided from the upstream end position of the nozzle array on the upstream side in sub scanning direction Y, to the downstream end position of the nozzle array on the downstream side, wherein two arrays are disposed for each color.

The inkjet recording apparatus 20 includes a control section (not shown) for control of the apparatus. According to respective processing programs and based on the status of operation, and the like, of a carriage driving mechanism, the recording heads 6 and 7, a conveying mechanism (not shown), the UV emitters 8, and the like, the control section controls operation of the respective members.

Particularly, in the inkjet recording apparatus 20, the control section selects respective ink jetting areas 14 for jetting ink from the image recording heads 6 and the auxiliary recording head 7, according to a recording mode, controls the image recording heads 6, the auxiliary recording head 7, the conveying mechanism 11, and the like, so that the selected ink jetting areas 14 jet ink to record an image. As recording modes, the apparatus includes a normal mode, a front recording mode, and a back recording mode.

Now, selection of ink jetting areas in the respective recording modes will be described in detail. When the normal mode is selected, the control section selects, as ink jetting areas 14 and as shown in FIG. 4A, each entire image recording head 6, that is, the both nozzle arrays of each image recording head 6, wherein two nozzle arrays are disposed for each color in sub scanning direction Y.

Figure 4:
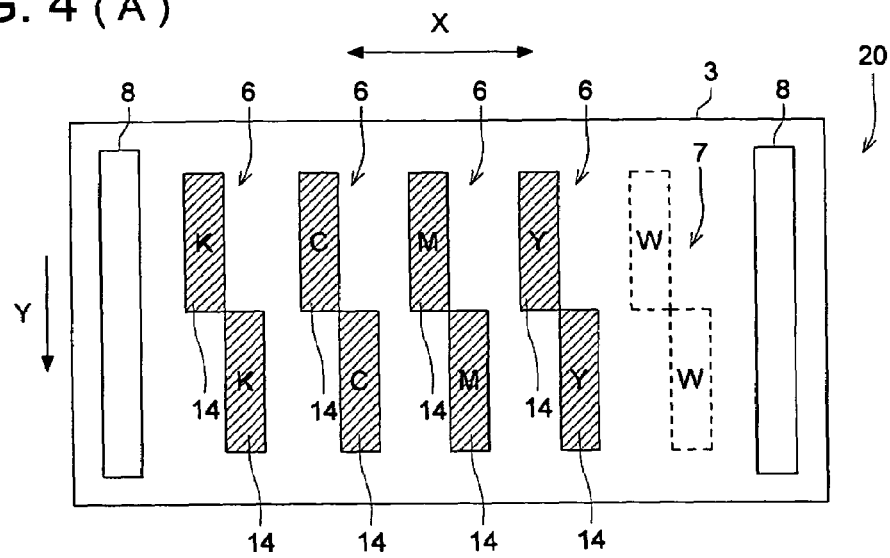
FIGS. 4A to 4C are schematic diagrams showing ink jetting areas of image recording heads and an auxiliary recording head of the inkjet recording apparatus in a second embodiment.
Figure 4:
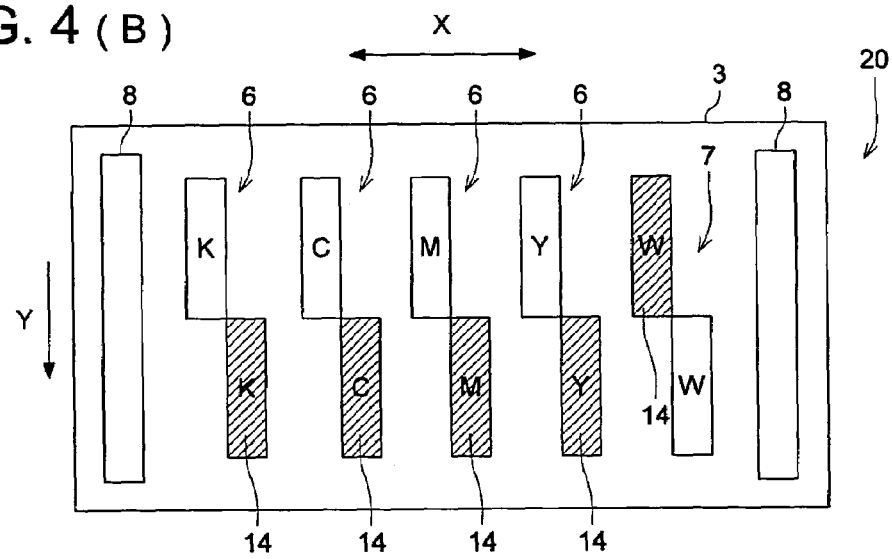
Figure 4:
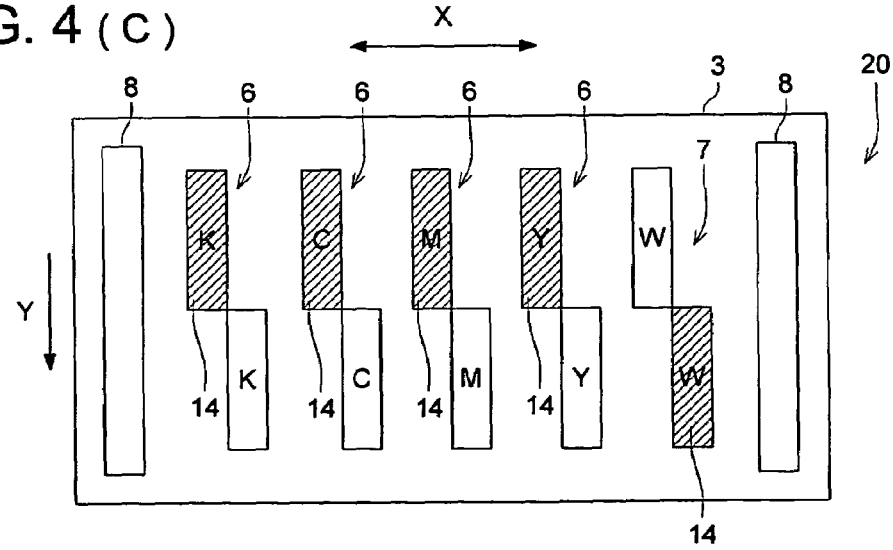

When the front recording mode is selected, the control section selects, as ink jetting areas 14 and as shown in FIG. 4B, the nozzle array of each image recording head 6 on the downstream side, wherein two nozzle arrays are disposed for each color in sub scanning direction Y, and selects the nozzle array of the auxiliary recording head 7 on the upstream side, as the ink jetting area 14 of the auxiliary recording head 7, wherein two nozzle arrays are disposed for the auxiliary recording head 7 in sub scanning direction Y.

When the back recording mode is selected, the control section selects, as the ink jetting areas 14 and as shown in FIG. 4C, the nozzle array of each image recording head 6 on the upstream side, wherein two nozzle arrays are disposed for each color in sub scanning direction Y, and selects the nozzle array of the auxiliary recording head 7 on the downstream side, as the ink jetting area 14 of the auxiliary recording head 7, wherein two nozzle arrays are disposed for the auxiliary recording head 7 in sub scanning direction Y.

Next, operation and functions of the present embodiment will be described.

Specifically, when the normal mode is selected in recording an image on a recording medium, the control section makes both the nozzle arrays of each image recording head 6 serve as the ink jetting area 14, wherein two nozzle arrays are disposed for each color. The entire image recording heads 6 are used to jet ink in the respective colors from nozzles based on image data. In both the outward direction and the return direction, the UV emitter 8, positioned on the downstream side of the recoding heads 6 in main scanning direction X, successively projects UV light onto ink having landed on the recording medium to cure the ink. Thus, an image without a background is recorded on the recording medium.

When the front recording mode is selected, the control section makes the nozzle arrays of each image recording head 6 on the downstream side in sub scanning direction Y, and the nozzle array of the auxiliary recording head 7 on the upstream side in sub scanning direction Y, serve as ink jetting areas 14. In each main scanning, white ink is jetted from the nozzle array on the upstream side in a solid-state, the nozzle array being one of the two nozzle arrays of the auxiliary recording head 7, and ink in each color is jetted from the nozzle array on the downstream side, based on image data, the nozzle array being one of the two nozzle arrays of each image recording head 6. In both the outward direction and the return direction, the UV emitter 8 positioned on the downstream side of the recoding heads in main scanning direction X successively projects UV light onto ink having landed on the recording medium.

Herein, the ink jetting area 14 of the auxiliary recording head 7 is positioned on the upstream side of the ink jetting areas 14 of the image recording heads 6 in sub scanning direction Y. In one main scanning, white ink is jetted in a solid-state from the auxiliary recording head 7, landed on the recording medium, and cured by UV light on the recording medium. Then, the portion onto which the white ink has been jetted in a solid state is conveyed in sub scanning direction Y. Thereafter, in the next one main scanning, ink is jetted from the image recording heads 6 onto this portion to record an image. In such a manner, an image with a white-colored background is recorded on the recording medium.

When the back recording mode is selected, the control section makes the nozzle arrays of each image recording head 6 on the upstream side in sub scanning direction Y, and the nozzle array of the auxiliary recording head 7 on the downstream side in sub scanning direction Y, serve as ink jetting areas 14. In each main scanning, ink in each color is jetted from the nozzle array on the upstream side, based on image data, the nozzle array being one of the two nozzle arrays of each image recording head 6, and white ink is jetted from the nozzle array on the downstream side in a solid-state, the nozzle array being one of the two nozzle arrays of the auxiliary recording head 7. In both the outward direction and the return direction, the UV emitter 8 positioned on the downstream side of the recoding heads in main scanning direction X successively projects UV light onto ink having landed on the recording medium.

Herein, the ink jetting areas 14 of the image recording heads 6 are positioned on the upstream side of the ink jetting areas 14 of the auxiliary recording head 7 in sub scanning direction Y. In one main scanning, inks in respective colors are jetted from the image recording heads 6, based on image data, landed on the recording medium, and cured by UV light on the recording medium. Then, the portion onto which an image has been recorded is conveyed in sub scanning direction Y. Thereafter, in the next one main scanning, white ink is jetted from the auxiliary recording head 7 onto this portion of the recording medium in a solid-state. In such a manner, an image with a white-colored background is recorded on the recording medium.

Superimposing image recording ink and auxiliary recording ink for image recording, as stated above, is possible by selecting nozzle arrays to jet ink in such a manner as follows. One of the two nozzle arrays, of each image recording head 6, disposed in sub scanning direction Y and one of the two nozzle arrays, of the auxiliary recording heads 7, disposed in sub scanning direction Y, are selected, wherein a nozzle array that performs recording earlier, namely initially, is located upstream of a nozzle array that performs recording later, namely subsequently. Herein, UV light is projected from the upstream portion, in sub scanning direction Y, of the UV emitters 8 arranged on the both sides of the recording head unit onto ink having been jetted on the upstream side to cure the ink. Therefore, it is neither necessary to provide an auxiliary recording head 7 on both sides of the group of the image recording heads 6, nor a UV emitter 8 between the group of image recording heads 6 and an auxiliary recording head 7.

Further, it is not necessary to provide an auxiliary recording head 7 on neither the upstream side nor the downstream side of the image recording heads 6 in sub scanning direction Y. Therefore, it is not necessary to arrange the UV emitters 8 with the total added length of an image recording head 6 and the auxiliary recording head 7 in sub scanning direction Y.

As stated above, in the present invention, it is not necessary to provide an auxiliary recording head 7 on both sides of the image recording heads 6, nor to provide an auxiliary recording head 7 on the upstream side nor the down stream side of the image recording heads 6 in sub scanning direction Y. Therefore, downsizing of the carriage 3 having the respective heads and downsizing of the entire apparatus can be attained, and manufacturing cost of the apparatus can be reduced. Since the area of the platen 9 for supporting a recording medium can be reduced, conveying accuracy is not lowered, providing images with higher quality.

Further, it is neither necessary to provide a UV emitter 8 between the group of the recording heads 6 and the auxiliary recording head 7, nor to provide a UV emitter 8 in a length of the total added length of an image recording head 6 and the auxiliary recording head 7. Therefore, downsizing of the apparatus and reducing the manufacturing cost of the apparatus can be achieved, and the amount of heat generation can be reduced, providing images with higher quality.

Likewise in the first embodiment, the invention is not limited to the present embodiment.

Next, an inkjet recording apparatus in a third embodiment of the invention will be described, referring to FIGS. 5A to 5C. An inkjet recording apparatus 30 in the present embodiment is structured almost the same as the apparatus in the first embodiment, except for disposition of image recording heads 6 and an auxiliary recording head 7, and control of the ink jetting operation. Therefore, only differences from the first embodiment will be specifically described below.

The inkjet recording apparatus 30 includes a carriage 3 which reciprocally moves above a recording medium in main scanning direction X driven by a carriage driving mechanism (not shown). In the central part of the carriage 3, image recording heads 6 formed with nozzles for jetting inks in the respective colors of yellow (Y), magenta (M) are disposed along sub scanning direction Y in a state where the heads are deviated from each other in main scanning direction X by the width of each head. Image recording heads 6 formed with nozzles for jetting inks in the respective colors of cyan (C) and black (K) are disposed along sub scanning direction Y likewise. For auxiliary recording ink that enhances image recording, there are also disposed two auxiliary recording heads 7 formed with nozzles for jetting white ink (W) for the background of an image recorded with image recording ink. Herein, white ink is jetted in a solid state, and the heads are deviated from each other in main scanning direction X by the width of each head.

On both sides of a head unit having image recording heads 6 and an auxiliary recording head 7, a UV emitter 8 for projecting UV light onto ink jetted from nozzles onto a recording medium is provided from the upstream end of the head unit in sub scanning direction Y, to the downstream end of the head unit.

Further, the inkjet recording apparatus 30 includes a control section (not shown) for control of the apparatus. According to respective processing programs and based on the status of operation of a carriage driving mechanism, the recording heads 6 and 7, a conveying mechanism (not shown), the UV emitters 8, and the like, the control section controls operation of the respective members.

Particularly, in the inkjet recording apparatus 30, the control section selects respective ink jetting areas 14 for jetting ink from the image recording heads 6 and the auxiliary recording head 7, according to a recording mode, controls the image recording heads 6, the auxiliary recording head 7, the conveying mechanism 11, and the like, so that the selected ink jetting areas 14 jet ink to record an image. As recording modes, the apparatus includes a normal mode, a front recording mode, and a back recording mode.

Selection of ink jetting areas in respective recording modes will be specifically described now. If a normal mode is selected, the control section selects, as shown in FIG. 5A, the entire recording heads of the respective image recording heads 6, that is, the entire nozzle arrays formed on the respective image recording heads 6, as the ink jetting area 14.

Figure 5:
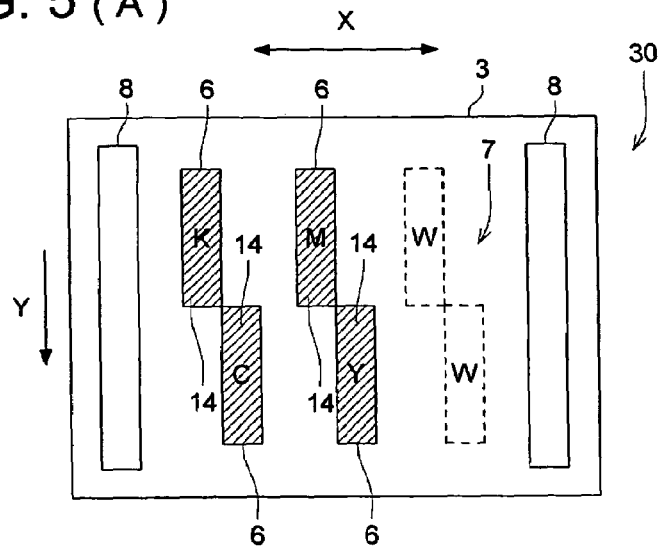
FIGS. 5A to 5C are schematic diagrams showing ink jetting areas of image recording heads and an auxiliary recording head of the inkjet recording apparatus in a third embodiment.
Figure 5:
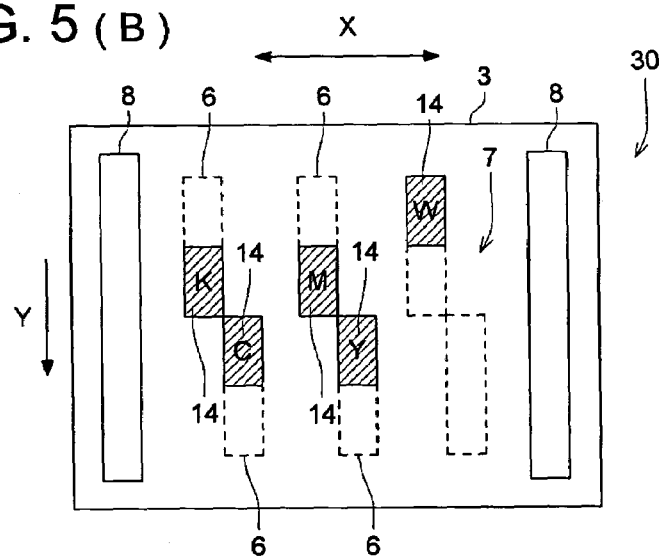
Figure 5:
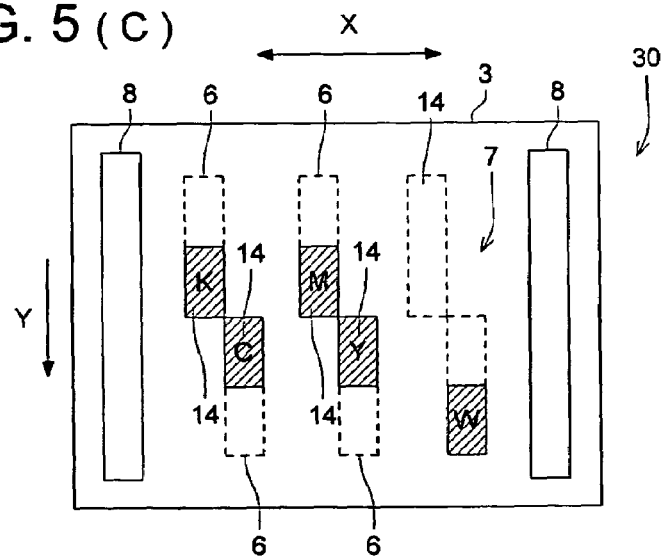

If the front recording mode is selected, for the respective image recording heads 6 of magenta (M) and black (K) located on the upstream side of the group of the image recording heads 6 in sub scanning direction Y, the control section selects, as the ink jetting area 14 and as shown in FIG. 5B, the downstream-side half of the nozzle array of each image recording head 6 in sub scanning direction Y. For the respective image recording heads 6 of yellow (Y) and cyan (C) located on the downstream side, the control section selects, as the ink jetting area 14, the upstream-side half of the nozzle array of each recording head 6 in sub scanning direction Y. For the auxiliary recording heads 7, the control section selects, as the ink jetting area 14, the upstream half of the nozzle array of the head on the upstream side in sub scanning direction Y.

If the back recording mode is selected, for the respective image recording heads 6 of magenta (M) and black (K) located on the upstream side in sub scanning direction Y, the control section selects, as shown in FIG. 5C, the downstream half of the nozzle array of each image recording head 6 in sub scanning direction Y, as the ink jetting area 14. For the respective image recording heads 6 of yellow (Y) and cyan (C) located on the downstream side, the control section selects the upstream half of the nozzle array of each recording head in sub scanning direction Y. For the auxiliary recording heads 7, the control section selects, as the ink jetting area 14, the downstream half of the nozzle array of the head on the downstream side in sub scanning direction Y.

Next, operations and functions of the present embodiment will be described below.

For recording an image on a recording medium, if the normal mode is selected, the control section selects the entire image recording heads 6 as the ink jetting area 14, and inks in the respective colors are jetted from nozzles according to image data, out of all nozzles. The UV emitter 8 positioned on the downstream side of the image recording heads 6 successively projects UV light onto ink having landed on the recording medium to cure the ink, in both the outward direction and return direction. Thus, an image with no background is recorded on the recording medium.

If the front recording mode is selected, for the image recording heads 6 of magenta (M) and black (K), the control section selects, as the ink jetting area 14, the downstream half of the nozzle array of each recording head in sub scanning direction Y. For the image recording heads 6 of yellow (Y) and cyan (C), the control section selects, as the ink jetting area 14, the upstream half of the nozzle array of each recording head in sub scanning direction Y. For the auxiliary recording heads 7, the control section selects, as the ink jetting area 14, the upstream half of the nozzle array of the auxiliary recording head 7 on the upstream side in sub scanning direction Y. In each scanning, white ink is jetted in a solid state from the upstream nozzles of auxiliary recording head 7 on the upstream side, and respective color inks are jetted from the downstream nozzles of each of the image recording heads 6 of magenta (M) and black (K) and from the upstream nozzles of the image recording heads 6 of yellow (Y) and cyan (C). The UV emitter 8 positioned on the downstream side, in main scanning direction X, of the head unit successively projects UV light onto ink having landed on the recording medium to cure the ink, in both the outward direction and return direction.

Herein, the ink jetting area 14 of the auxiliary recording head 7 is positioned on the upstream side of the ink jetting area 14 of the image recording heads 6 in sub scanning direction Y. In one main scanning, white ink is jetted from the auxiliary recording head 7 in a solid state, landed on the recording medium, and cured on the recording medium. Then, the portion on which the white ink has been jetted in a solid state is conveyed in sub scanning direction Y, and ink is jetted from the image recording heads 6 of magenta (M) and black (K) onto this portion in the next one main scanning. After the inks in the respective colors of magenta (M) and black (K) have been cured by UV light, the image portion where the image has been recorded with the inks in the respective colors of magenta (M) and black (K) on the white ink jetted in the solid state is conveyed in sub scanning direction Y. In the further next one main scanning, an image is recorded on this conveyed portion by jetting ink from the image recording heads 6 of yellow (Y) and cyan (C). Thus, a color image with a white background is recorded on the recording medium.

If the back recording mode is selected, for the image recording heads 6 of magenta (M) and black (K), the control section selects, as the ink jetting area 14, the downstream half of the nozzle array of each image recording head 6 in sub scanning direction Y. For the image recording heads 6 of yellow (Y) and cyan (C), the control section selects, as the ink jetting area 14, the upstream half of the nozzle array of each image recording head 6 in sub scanning direction Y. For the auxiliary recording heads 7, the control section selects, as the ink jetting area 14, the downstream half, in sub scanning direction Y, of the nozzle array of the auxiliary recording head 7 on the downstream side in sub scanning direction Y. In each scanning, respective color inks are jetted onto the back surface from the nozzles on the downstream side of the respective nozzle arrays of the image recording heads 6 of magenta (M) and black (K) and from the nozzles on the upstream side of the respective nozzle arrays of the image recording heads 6 of yellow (Y) and cyan (C), and white ink is jetted in a solid state from the nozzles on the downstream side of the nozzle array of the auxiliary recording head 7 on the downstream side. The UV emitter 8 positioned on the downstream side, in main scanning direction X, of the head unit successively projects UV light onto ink having landed on the recording medium to cure the ink, in both the outward direction and return direction.

Herein, the ink jetting areas 14 of the image recording heads 6 are positioned on the upstream side, in sub scanning direction Y, of the ink jetting area 14 of the auxiliary recording heads 7. In one main scanning, respective color inks are jetted in such a manner as follows, based on image data. Ink is jetted from the image recording heads of magenta (M) and black (K) first and cured on the recording medium by UV light. Then, the portion where the image has been recorded is conveyed in sub scanning direction Y. In the next one main scanning, ink is jetted from the image recording heads 6 of yellow (Y) and cyan (C) onto the portion of the image having been recorded with the respective color inks in magenta (M) and black (K). After the inks in the respective colors of yellow (Y) and cyan (C) are cured by UV light, the image portion where the image has been recorded with the inks in the respective colors is conveyed in sub scanning direction Y. In the further next one main scanning, white ink is jetted in a solid state onto this image portion from the auxiliary recording head 7. Thus, a color image with a white background is recorded on the recording medium.

Thus, in a case where image recording ink and auxiliary recording ink are to be superimposed, recording can be performed in such a manner that the nozzle area of a head that jets ink initially is selected to be on the upstream side, in the sub scanning direction, of the nozzle area of a head that jets ink subsequently. Thus, jetted ink on the upstream side is exposed to UV light projected from the upstream side portion, in sub scanning direction Y, of the UV emitters 8 provided on both sides of the head unit, and thus cured. Therefore, it is neither necessary to provide an auxiliary recording head 7 on both sides of the group of the image recording heads 6, nor to provide a UV emitter 8 between the group of the image recording heads 6 and the auxiliary recording head 7.

Further, it is not necessary to provide an auxiliary recording head 7 on neither the upstream side nor the downstream side of the image recording heads 6 in sub scanning direction Y. Therefore, it is not necessary to arrange the UV emitters 8 with the total added length of an image recording head 6 and the auxiliary recording head 7 in sub scanning direction Y.

As stated above, in the present invention, it is not necessary to provide an auxiliary recording head 7 on both sides of the image recording heads 6, nor to provide an auxiliary recording head 7 on the upstream side nor the down stream side of the image recording heads 6 in sub scanning direction Y. Therefore, downsizing of the carriage 3 having the respective heads and downsizing of the entire apparatus can be attained, and manufacturing cost of the apparatus can be reduced. Since the area of the platen 9 for supporting a recording medium can be reduced, conveying accuracy is not lowered, providing images with higher quality.

Further, it is neither necessary to provide a UV emitter 8 between the recording heads 6 and the auxiliary recording head 7, nor to provide the UV emitters 8 in the length of the total added length of an image recording head 6 and an auxiliary recording head 7. Therefore, downsizing of the apparatus and reducing the manufacturing cost of the apparatus can be achieved, and the amount of heat generation can be reduced, providing images with higher quality.

Likewise in the first embodiment, the invention is not limited to the present embodiment. Particularly in the present embodiment, regarding the image recording heads 6, in both the front recording mode and the back recording mode, each downstream half in sub scanning direction Y of the nozzle array of the image recording heads 6 of magenta (M) and black (K), and each upstream half in sub scanning direction Y of the nozzle array of the image recording heads 6 of yellow (Y) and cyan (C), are selected as the ink jetting areas 14. However, in the front recording mode, downstream half of the nozzle array of each image recording head 6 in sub scanning direction Y may be selected as the ink jetting area 14, commonly to all the image recording heads 6. Further, in the back recording mode, upstream half of the nozzle array of each image recording head 6 in sub scanning direction Y may be selected as the ink jetting area 14, commonly to all the image recording heads 6.

In the aforementioned embodiments, background ink is jetted mostly in a solid state. However, the invention is not limited to this, and various types of backgrounds including, for example, background with gradation can be recorded.

The invention includes the following structures.

(1) An inkjet recording apparatus includes an image recording head formed with nozzles for jetting image recording ink mainly for recording an image onto a recording medium conveyed in a sub scanning direction orthogonal to a main scanning direction while the recording head is reciprocally moving in the main scanning direction, an auxiliary recording head formed with nozzles for jetting auxiliary recording ink for enhancement of recording of an image while the auxiliary recording head is reciprocally moving in the main scanning direction, the auxiliary recording head and the image recording head being aligned in the main scanning direction, and a control section that selects, according to a recording mode, respective ink jetting areas, in terms of the sub scanning direction, of the image recording head and the auxiliary recording head, the areas being for jetting ink, and controls the image recoding head and the auxiliary recording head so that the recording heads jet ink from the selected ink jetting areas.

According to above item (1), according to a recording mode, respective ink jetting areas of the image recoding head and the auxiliary recording head are selected in terms of the sub scanning direction, the areas being for jetting ink. Therefore, for example, in the case of jetting image recording ink, superimposing onto auxiliary recording ink, the upstream part, in terms of the sub scanning direction, of the auxiliary recording head is selected as the ink jetting area of the auxiliary recording head, while the downstream part, in terms of the sub scanning direction, of the image recording head is selected as the ink jetting area of the image recording head. Thus, in this case, ink is jetted from the auxiliary recording head during one main scanning, then the recording medium on which recording has been performed with the auxiliary recording ink is conveyed in the sub scanning direction, and then ink is jetted from the image recording head during the next one main scanning. Therefore, it is neither necessary to provide an auxiliary recording head on both side positions of the image recording head, nor to provide an auxiliary recording head on the upstream side of the image recording head in the sub scanning direction.

(2) As recording modes, the inkjet recording apparatus of item (1) includes more than one of recording modes, the modes being a normal mode for recording with only the image recording ink, an initial recording mode for performing image recording with the image recording ink first and superimposing auxiliary recording ink on the image recording ink, and a subsequent recording mode for jetting the auxiliary recording ink first and then superimposing the image recording ink on the auxiliary recording ink. Herein, in the normal mode, the control section controls the image recording head such that the entire image recording head jets ink as the ink jetting area. In the initial recording mode, the control section controls the image recording head and the auxiliary recording head to jet ink such that the ink jetting area of the image recording head is on the upstream side in the sub scanning direction of the image jetting area of the auxiliary recording head. In the subsequent recording mode, the control section controls the image recording head and the auxiliary recording head to jet ink such that the ink jetting area of the image recording head is on the downstream side in the sub scanning direction of the image jetting area of the auxiliary recording head.

According to item (2), in the normal mode, ink is jetted from the entire image recording head, based on image data, to record an image on the recording medium without a background.

In the initial recording mode, as the ink jetting area of the image recording head is located on the upstream side of the ink jetting area of the auxiliary recording head in the sub scanning direction. Therefore, auxiliary recording ink is superimposed on an image recorded with image recording ink in such a manner that the image is recorded by jetting ink from the image recording head in one main scanning, then the portion on which the image has been recorded is conveyed in the sub scanning direction and then ink is jetted from the auxiliary recording head onto the recorded portion in the next one main scanning.

In the subsequent recording mode, as the ink jetting area of the auxiliary recording head is located on the upstream side of the ink jetting area of the image recording head in the sub scanning direction. Therefore, image recording ink is superimposed on auxiliary recording ink to record an image in such a manner that ink is jetted from the auxiliary recording head in one main scanning, then the portion on which recording has been performed with the auxiliary ink is conveyed in the sub scanning direction, and then ink is jetted from the image recording head onto this portion in the next one main scanning to record the image.

(3) In the inkjet recording apparatus of item (2), the auxiliary recording ink is a background ink to be used for recording of the background of an image, wherein the initial recording mode is a back recording mode in which an image is recorded on the back surface of the recording medium with the image recording ink and then the background ink is jetted in a solid state, superimposedly on the image, and the subsequent recording mode is a front recording mode in which the background ink is jetted onto the front surface of the recording medium, and then an image is recorded with the image recording ink, superimposedly on the background ink.

According to (3), in the back recording mode, the ink jetting area of the image recording head is positioned on the upstream side of the ink jetting area of the auxiliary recording head in the sub scanning direction. Therefore, ink is jetted from the image recording head onto the back surface of the recording medium from the image recording head in one main scanning to record an image, then the portion where the image has been recorded is conveyed in the sub scanning direction, and the background ink is jetted onto the portion in a solid state from the auxiliary recording head in the next one main scanning. Thus, an image is recorded with the image recording ink with a background recorded with the background ink.

In the front recording mode, the ink jetting area of the auxiliary recording head is positioned on the upstream side of the ink jetting area of the image recording head in the sub scanning direction. Therefore, the background ink is jetted in a solid state from the auxiliary recording head in one main scanning, then the portion where the auxiliary recording ink has been jetted in a solid state is conveyed in the sub scanning direction, and ink is jetted onto this portion from the image recording head in the next one main scanning. Thus, an image is recorded with the image recording ink with a background recorded by jetting the background ink in a solid state.

(4) In the inkjet recording apparatus in item (3), the background ink is white ink.

According to item (4), in the front recording and the back recording modes, an image with a background of white ink is recorded.

(5) In the inkjet recording apparatus of any one of items (1) to (4), each ink jetting area is one of the upstream-side area, downstream-side area, or the entire, of a nozzle array including nozzles disposed in the sub scanning direction.

According to item (5), images corresponding to various respective recording modes can be recorded by a single image recording head and a single auxiliary recording head for the respective same kinds of ink.

(6) In the inkjet recording head of any one of items (1) to (4), a plurality of image recoding nozzle arrays for jetting the same kind of ink and a plurality of auxiliary recording nozzle arrays for jetting the same kind of ink are respectively disposed in the sub scanning direction, wherein each ink jetting area is one of an upstream-side array, downstream-side array, and all recording arrays of the plurality of recording nozzle arrays for jetting the same kind of ink.

According to item (6), even in a case where a plurality of image recording arrays and a plurality of auxiliary recording nozzle arrays are provided for respective same kinds of ink, it is possible to record images corresponding to various recording modes.

(7) The inkjet recording apparatus of any one of items (1) to (6) uses photocurable ink which is cured by projecting light, and is provided with a light emitter, on both sides of a head unit having the image recording and auxiliary recording heads, for projecting light onto the ink having been jetted from the image recording head and the auxiliary recording head and landed on the recording medium to cure the ink.

According to item (7), in a case where image recording ink and auxiliary recording ink are superimposedly recorded, recording can be performed in such a manner that the ink jetting area of a head that initially jets recording ink is selected to be on the upstream side of the ink jetting area of a head that subsequently jets recording ink, in the sub scanning direction. Thus, jetted ink on the upstream side is exposed to light projected from the upstream side, in the sub scanning direction, of the light emitters provided on both sides of the head unit and cured. Therefore, it is not necessary to provide an auxiliary recording head on both sides of the image recording head, or provide a light emitter between the image recording head and the auxiliary recording head.

Further, it is not necessary to provide an auxiliary recording head neither on the upstream side nor the downstream side of the image recording head in the sub scanning direction. Accordingly, the light emitters need not to be provided with the total added length of the image recording head and the auxiliary recording head in the sub scanning direction.

(8) In the inkjet recording apparatus of any one of items (1) to (7), the inks are UV-curable inks which are cured by being exposed to UV light, wherein the light emitters are UV emitters for emitting UV light.

According to item (8), it is neither necessary to provide a UV emitter between the image recording head and the auxiliary recording head, nor to provide the UV emitters with the total added length of the image recording head and the auxiliary recording head in the sub scanning direction.

According to item (1), it is neither necessary to provide an auxiliary recording head on both sides of the image recording head, nor to provide an auxiliary recording head on the upstream side of the image recording head in the sub scanning direction. Therefore, it is possible to downsize a carriage having recording heads on it and downsize the entire apparatus, and reduce the manufacturing cost of the apparatus. Further, as it is not necessary to make the area of a platen for supporting a recording medium large, conveying accuracy is not degraded, and thus images with higher quality is provided.

According to item (2), even in a case where an inkjet recording apparatus includes more than one recording modes of a normal recording mode, initial recording mode, and subsequent recording mode, it is neither necessary to provide an auxiliary recording head on both sides of the image recording head, nor to provide an auxiliary recording head on the upstream side of the image recording head in the sub scanning direction. Therefore, it is possible to downsize a carriage having recording heads on it and downsize the entire apparatus, and reduce the manufacturing cost of the apparatus. Further, since it is not necessary to make the area of a platen for supporting a recording medium large, conveying accuracy is not degraded, and thus images with higher quality is provided.

According to item (3), even in a case where an inkjet recording apparatus includes a recording mode which records a background and an image, it is possible to downsize the size of the apparatus and reduce the manufacturing cost of the apparatus, and provide images with higher quality.

According to item (4), even in a case where an inkjet recording apparatus includes a recording mode that records an image with a background of white ink, it is possible to downsize the size of the apparatus and reduce the manufacturing cost of the apparatus, and provide images with higher quality.

According to item (5), even in a case where images corresponding to various respective recording modes are recorded by a single image recording head and a single auxiliary recording head for the respective same kinds of ink, it is possible to downsize the size of the apparatus and reduce the manufacturing cost of the apparatus, and provide images with higher quality.

According to item (6), even in a case where a plurality of image recording nozzle arrays and a plurality of auxiliary recording nozzle arrays are provided for the respective same kinds of ink, and images corresponding to various respective recording modes are recorded, it is possible to downsize the size of the apparatus and reduce the manufacturing cost of the apparatus, and provide images with higher quality.

According to item (7), it is neither necessary to provide an auxiliary recording head on both sides of image recording heads, nor to provide an auxiliary recording ink neither on the upstream side or the downstream side of the image recording heads in the sub scanning direction. Therefore, it is possible to downsize a carriage having recording heads on it and the entire apparatus, and reduce the manufacturing cost of the apparatus. Further, it is not necessary to make the area of a platen for supporting a recording medium large, conveying accuracy is not degraded, and thus images with higher quality are provided.

Further, it is neither necessary to provide a light emitter between image recording heads and an auxiliary recording head, nor to provide light emitters with the total added length of an image recording head and an auxiliary recording head in the sub scanning direction. Therefore, it is possible to downsize the size of the apparatus, reduce the manufacturing cost of the apparatus, decrease the amount of heat generation, and provide images with higher quality.

According to item (8), it is neither necessary to provide a light emitter between image recording heads and an auxiliary recording head, nor to provide light emitters with the total added length of an image recording head and an auxiliary recording head in the sub scanning direction. Therefore, it is possible to downsize the size of the apparatus, reduce the manufacturing cost of the apparatus, decrease the amount of heat generation, and provide images with higher quality.

What is claimed is:

1. An inkjet recording apparatus, comprising:

a plurality of image recording heads disposed in a single row in a main scanning direction for jetting image recording ink onto a recording medium conveyed in a sub scanning direction orthogonal to the main scanning direction, while reciprocally moving in the main scanning direction, wherein each image recording head has an image recording nozzle array including a plurality of nozzles for jetting ink, the image recording nozzle array being disposed along the sub scanning direction; and an auxiliary recording head disposed in the single row where the image recording heads are disposed for jetting auxiliary recording ink for enhancing image recording onto the recording medium, while reciprocally moving in the main scanning direction, the auxiliary recording head having an auxiliary recording nozzle array including a plurality of nozzles for jetting ink, the auxiliary recording nozzle array being disposed along the sub scanning direction in parallel to the image recording nozzle array, a control section for controlling the image recording heads and the auxiliary recording head so as to change respective ink jetting areas by selecting nozzle arrays for respectively jetting ink, from the image recording nozzle array and the auxiliary recording nozzle array, according to a recording mode;

the inkjet recording apparatus, having more than one of a normal mode of recording an image by a use of the image recording ink only, an initial recording mode of subsequently superimposing the auxiliary recording ink after initially recording an image on the recording medium with the image recording ink, and a subsequent recording mode of subsequently superimposing an image with the image recording ink after initially jetting the auxiliary recording ink, wherein, in the normal mode, the control section selects the entire image recording nozzle arrays as nozzles for image recording to jet ink, and controls the image recording nozzle arrays such that the nozzles of the image recording nozzle arrays respectively jet ink;

in the initial recording mode, the control section selects image recording nozzles, for jetting the image recording ink, from the image recording nozzle array, and selects auxiliary recording nozzles, for jetting the auxiliary recording ink, from the auxiliary recording nozzle array such that the image recording nozzles for jetting the image recording ink are on an upstream side, in the sub scanning direction, of the auxiliary recording nozzles for jetting the auxiliary recording ink, and controls the image recording nozzle arrays and the auxiliary recording nozzle arrays such that the selected nozzles respectively jet ink; and in the subsequent recording mode, the control section selects image recording nozzles, for jetting image recording ink, from the image recording nozzle array, and selects auxiliary recording nozzles, for jetting auxiliary recording ink, from the auxiliary recording nozzle array such that the image recording nozzles for jetting image recording ink are on a downstream side, in the sub scanning direction, of the auxiliary recording nozzles, and controls the image recording nozzle array and the auxiliary recording nozzle array such that the selected nozzles respectively jet ink.

2. The inkjet recording apparatus of claim 1, wherein the inks are photo curable inks which are cured by being exposed to light, and the apparatus comprises light emitters for projecting light onto the inks having been jetted from the image recording head and the auxiliary recording head and landed on the recording medium so that the inks are cured, and the light emitters are disposed in the single row in main scanning direction where the image recording heads and auxiliary recording head are disposed and the light emitters are disposed not between the image recording heads and the auxiliary recording head but on only both side portions of a head unit having the image recording heads and the auxiliary recording head.

3. An inkjet recording apparatus, comprising:

a plurality of image recording heads disposed in a single row in a main scanning direction for jetting image recording ink of a plurality of colors onto a recording medium conveyed in a sub scanning direction orthogonal to the main scanning direction, while reciprocally moving in the main scanning direction, wherein each image recording head comprises two nozzle arrays jetting a same color of ink, the two nozzle arrays jetting the same color of ink being shifted from each other by a width of the nozzle array in the main scanning direction and disposed adjacent each other on an upstream side and on a downstream side in the sub scanning direction, wherein each nozzle array comprises a plurality of nozzles for jetting ink disposed in the sub scanning direction;

an auxiliary recording head disposed in the single row in the main scanning direction where the image recording heads are disposed, for jetting auxiliary recording ink for enhancing image recording onto the recording medium while reciprocally moving in the main scanning direction, and comprising two nozzle arrays jetting the auxiliary ink, the two nozzle arrays being shifted from each other by a width of the nozzle array in the main scanning direction and disposed adjacent each other on an upstream side and a downstream side in the sub scanning direction, wherein each nozzle array comprises a plurality of nozzles for jetting ink disposed in the sub scanning direction; and a control section for controlling the image recording heads and the auxiliary recording head so as to change respective ink jetting areas by selecting nozzle arrays for respectively jetting ink, from the image recording nozzle arrays and the auxiliary recording nozzle arrays, according to a recording mode;

the inkjet recording apparatus, having more than one of a normal mode of recording an image by the image recording ink only, an initial recording mode of subsequently superimposing the auxiliary recording ink after initially recording an image on the recording medium with the image recording ink, and a subsequent recording mode of subsequently superimposing an image with the image recording ink after initially jetting the auxiliary recording ink, wherein in the normal mode, the control section selects both nozzle arrays of each image recording head, as ink jetting area, wherein two nozzle arrays are disposed for each color in sub scanning direction, in the initial recording mode, the control section selects the nozzle array of each image recording head on the upstream side, as ink jetting area of the image recording head, wherein two nozzle arrays are disposed for each color in sub scanning direction, and selects the nozzle array of the auxiliary recording head on the downstream side, as the ink jetting area of the auxiliary recording head, wherein two nozzle arrays are disposed for the auxiliary recording head in sub scanning direction, and in the subsequent recording mode, the control section selects the nozzle array of each image recording head on the downstream side, as the ink jetting area of the image recording head, wherein two nozzle arrays are disposed for each color in the sub scanning direction, and selects the nozzle array of the auxiliary recording head on the upstream side, as the ink jetting area of the auxiliary recording head, wherein two nozzle arrays are disposed for the auxiliary recording head in the sub scanning direction.

4. The inkjet recording apparatus of claim 3, wherein the inks are photo curable inks which are cured by being exposed to light, and the apparatus comprises light emitters for projecting light onto the inks having been jetted from the image recording heads and the auxiliary recording head and landed on the recording medium so that the inks are cured, and the light emitters are disposed in the single row in the main scanning direction where the image recording heads and the auxiliary recording head are disposed and the light emitters are disposed not between the image recording heads and the auxiliary recording head but on only both side portions of a head unit having the image recording heads and the auxiliary recording head.

* * * * *